United States Patent [19]

Thalenfeld

[11] Patent Number: 4,512,481

[45] **Date of Patent: * Apr. 23, 1985**

[54] MERCHANDISE DISPLAY HOOK

[75] Inventor: David R. Thalenfeld, Beachhurst, N.Y.

[73] Assignee: Trion Industries, Inc., Wilkes-Barre, Pa.

[ * ] Notice: The portion of the term of this patent subsequent to Mar. 13, 2001 has been disclaimed.

[21] Appl. No.: 533,342

[22] Filed: Sep. 19, 1983

Related U.S. Application Data

[60] Division of Ser. No. 303,419, Sep. 18, 1981, Pat. No. 4,436,209, which is a continuation-in-part of Ser. No. 151,357, May 19, 1980, Pat. No. 4,351,440, which is a continuation-in-part of Ser. No. 918,483, Jun. 23, 1978, abandoned.

[51] Int. Cl.[3] ..... A47F 5/00

[52] U.S. Cl. ..... 211/57.1; 248/220.4; 248/222.2

[58] Field of Search ..... 248/220.2, 220.3, 220.4, 248/221.1, 221.2, 221.3, 222.2; 211/57.1, 59.1, 54.1

[56] References Cited

U.S. PATENT DOCUMENTS

| | | | |
|---|---|---|---|
| 2,987,286 | 6/1961 | Alling . | |
| 3,275,272 | 9/1966 | Kirk | 248/220.4 |
| 3,289,993 | 12/1966 | Thalenfeld | 248/220.4 |
| 3,409,260 | 11/1968 | Bleed | 248/221.1 |
| 3,711,048 | 1/1973 | Thalenfeld | 248/221.1 X |
| 4,026,508 | 5/1977 | Ziegler | 211/59.1 X |
| 4,351,440 | 9/1982 | Thalenfeld | 211/57.1 |

OTHER PUBLICATIONS

Trion Industries Inc., "Point of Purchase Catalog P500", (8 pages).

*Primary Examiner*—Robert W. Gibson, Jr.
*Attorney, Agent, or Firm*—Mandeville and Schweitzer

[57] ABSTRACT

The disclosure relates to an advantageous form of self-locking display hook assembly, of the type including an outwardly extending merchandise element provided with a horizontal hinge bar. A base member is pivoted on the hinge bar and is provided with rearwardly and upwardly projecting L-shaped mounting lugs for mounting the base member on an apertured display panel. The relationship of the hinge bar to the L-shaped mounting lugs is such that, in the mounted position of the hook, the axis of the hinge bar is at a level above the top of the panel apertures in which the mounting lugs are received. This geometric relationship assures that the pivoted base member is "self-locking" against forces tending to dislodge the assembly from the display panel.

4 Claims, 7 Drawing Figures

FIG.1
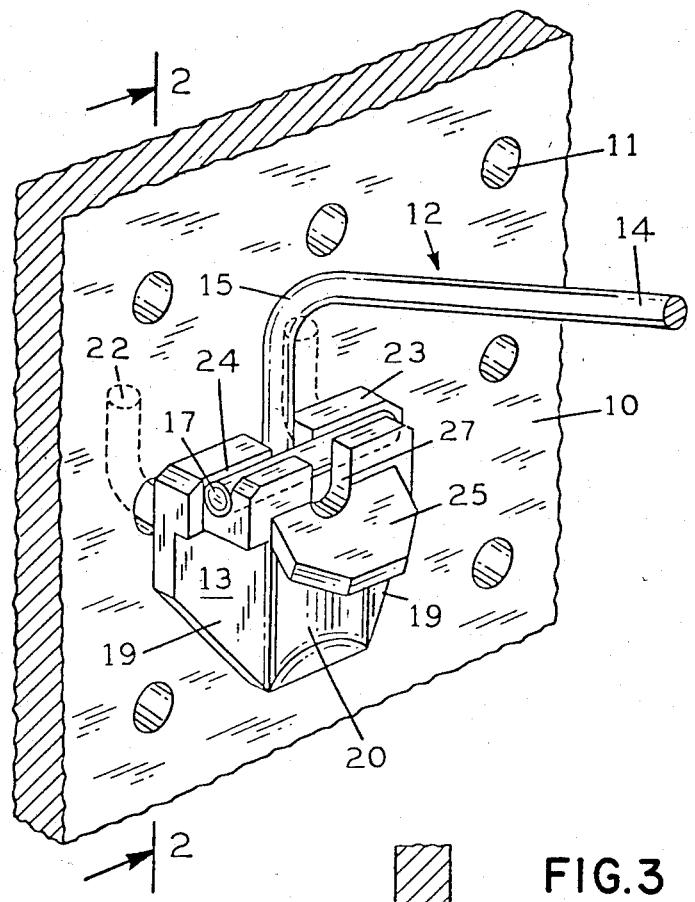
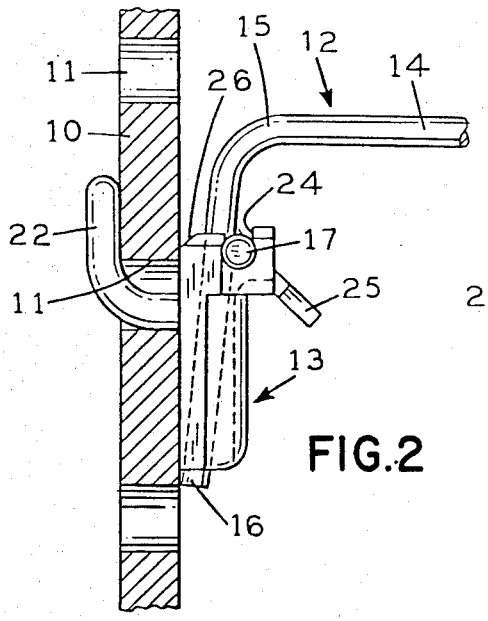
FIG.2
FIG.3
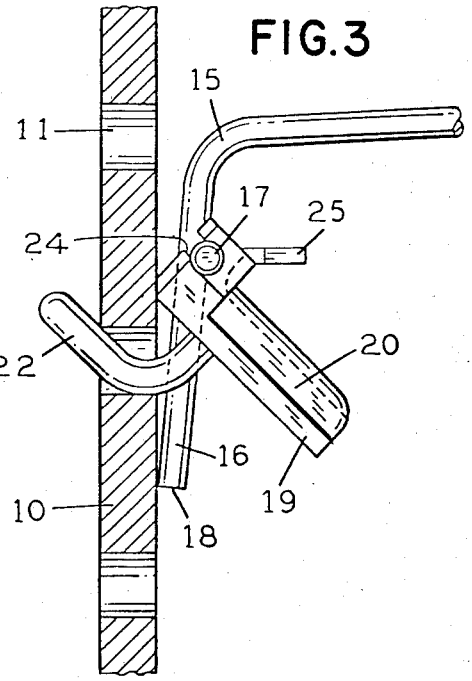

MERCHANDISE DISPLAY HOOK

This application is a division of my copending application Ser. No. 303,419, filed Sept. 18, 1981, now U.S. Pat. No. 4,436,209. The copending parent application was a continuation-in-part of my earlier application Ser. No. 151,357 filed May 19, 1980, now U.S. Pat. No. 4,351,440, which in turn was a continuation-in-part of my prior application Ser. No. 918,483 filed June 23, 1978, now abandoned.

BACKGROUND AND SUMMARY OF THE INVENTION

In the setting up of merchandise displays, using so-called peg board hooks mounted on perforated panel board, the ability to easily install and remove the merchandise display hooks, and the ability to maximize the utilization of the panel board space with merchandise displays are important considerations to the efficient merchandiser. The most primitive and inexpensive form of merchandise display hook consists of an elongated wire support, welded or otherwise secured to a base, having a pair of L-shaped mounted lugs. By tilting the hook upwardly, the lugs may be inserted into and/or removed from apertures in the panel board. However, the need for the hook to be tilted upwardly during installation and removal significantly reduces the efficiency of the display because of the need for providing clearance space above each hook.

The Thalenfeld U.S. Pat. No. 3,289,993 represented an important advance in the design of merchandise hooks in that a base member, providing with spaced, L-shaped mounting lugs, was mounted for pivoting movement with respect to an outwardly extending merchandise supporting wire. For installation and/or removal of that hook, was not necessary to tilt upwardly the entire hook, but only to pivot the base member. By enabling hooks to be inserted and removed without significant vertical clearance, not only was it possible to achieve greater utilization of the panel board space for merchandise displays, but perhaps equally important, the task initially setting up a display was greatly expedited. With respect to the latter aspect, during the initial set up of a display, it is frequently necessary to relocate hooks after a preliminary installation, in order to improve the appearance and/or space utilization of the panel. With the hook of the Thalenfeld U.S. Pat. No. 3,289,993, such operations were greatly enhanced, enabling significant labor savings to be realized.

Although the hook of the Thalenfeld U.S. Pat. No. 3,289,993 is a functionally superior hook, which has enjoyed enormous commercial success, it is necessarily somewhat higher in manufacturing cost than hooks of more simplified, functionally inferior design, so that a demand has continued for merchandise hooks of lower cost construction.

One type of hook that has achieved a certain market share in competition with the functionally superior hook of the aforementioned Thalenfeld Patent is the two-part, plastic base hook as represented in a general way in, for example, the Lucietto et al U.S. Pat. No. 3,452,954 and/or the Silver U.S. Pat. No. 3,897,926. These patents are generally representative of hooks which comprise a formed wired merchandise support and a separate, molded plastic base provided with L-shaped mounting lugs. Both the wire merchandise support and the plastic base may be mass-produced on a low-cost basis, aided in no small measure by the fact that the original manufacturer need not assemble the parts prior to the delivery to the customer. Installation of the hook by the customer includes on-site assembly of the wire and base components. Where high density space utilization is required, the base element alone can be first installed on the panel board and the wire support may then be assesmbled to the base. In order to remove the hook, the wire element is first disassembled from the base, and then the base is removed from the panel. If display density is not a factor (i.e. there is ample clearance space above the hook) the hook may simply be tipped up and removed in its assembled position, much the same the more primitive form of hook described above.

Although the two-part, plastic base hooks described in the preceding paragraph have achieved a reasonable market share, because of favorable manufacturing costs comparisons in relation to the hook of the Thalenfeld patent mentioned above, the two-part hooks remain functionally very inferior to the hook with the pivoting base. Not only is installation and removal substantially more complicated, but the merchandiser is frequently dealing with multiple parts, which results in reduced efficiencies.

In accordance with the present invention, a new and improved merchandise hook is provided which has essentially all the superior functional characteristics of the hook of the Thalenfeld U.S. Pat. No. 3,289,993, yet is fully price competitive with the more conventional, two-part plastic based hooks. More specifically, the hook of the present invention comprises a wire merchandise supporting element which is cooperatively joined with a molded plastic base. Unlike the conventional two-part plastic base hooks, however, the hook of the invention, after initial assembly of the wire element to the plastic base, becomes a unitiary assembly with the base having a pivotal relationship to the hook to accommodate facile installation and/or removal of the hook without the cumbersome and time-consuming manipulations required of the more conventional two-piece plastic base constructions.

Importantly, even though the hook of the present invention eventually results in a "permanently" assembled hook and base, the initial assembly need not be made until installation at the customers display location. As a result, assembly of the base and hook is not an element of manufacturing costs.

An important feature of the invention resides in the design of an improved pivoting base merchandise hook in which the geometry of the hook and base is such as to render the hook substantially self-locking against accidental dislodgement. In this respect, the pivot axis of the base member is advantageously positioned in relation to the mounting lugs of the base, such that the pivot axis is above the top of the panel openings in which the lugs are received. In addition, the hinge bar is positioned well below the upper extremity on the wire member. As a result, upward force tilting applied to the wire merchandise support is effectively prevented from causing a release motion of the pivoting base member and indeed tends to tighten it.

For a more complete understanding of the above and other features and advantages of the invention, reference should be made to the following detailed description of a preferred embodiment and to the accompanying drawings.

DESCRIPTION OF THE DRAWINGS

FIG. 1 is a front perspective view of the new merchandise hook of the invention, showing the wire merchandise support and the plastic base in assembled, installed, condition.

FIG. 2 is a cross-sectional view as taken generally on line 2—2 of FIG. 1, illustrating the hook in its normal condition, mounted on a perforated display panel.

FIG. 3 is a cross-sectional view of a similar to FIG. 2, illustrating the hook with its base member pivoted upwardly, in a position for effecting removal and/or installation.

DESCRIPTION OF PREFERRED EMBODIMENT

Figure 4:
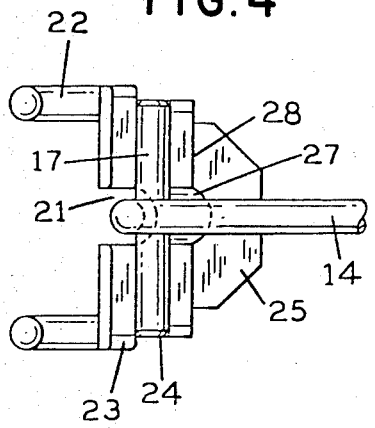
FIGS. 4 and 5 are top and bottom plan views respectively of the new hook, showing details of construction of the molded plastic base member.

Referring now to the drawing, the reference numeral 10 designation generally a typical perforated panel display board provided with a large plurality of uniformly spaced openings 11 for the reception of hook-mounting lugs. The merchandise hook of the invention consists of two basic components, a wire element 12 and a base element 13. These two components are separately manufactured and, typically, are assembled by the customer to provide a working device.

The wire element 12 of the new hook assembly may be produced on high speed wire forming equipment and includes a generally straight, typically upwardly inclined merchandise supporting section 14. The outer end of the wire element is not illustrated, but may have any desired configuration, such as ball end, so-called "safety bend" or other desired configuration. At its inner end, the wire element 12 has a radius bend 15 from which extends downwardly a stabilizing leg 16. A short hinge bar 17 is welded to the front face of the stabilizing leg 16, well below the radius bend 15, and also well above the lower extremity 18 of the stabilizing leg.

It is contemplated that the welded-on hinge bar 17 will be joined with the main section of the wire element 12 as part of the high speed wire forming operations. By way of example only, it is contemplated that the hinge bar may be welded to the main wire section as part of a continuous sequence of operations, to be followed by cutting to length and bending to shape of the wire section. The axis of the hinge bar is controlled to be perpindicular to the axis of the stabilizing leg 16 and also perpendicular to the plane containing the leg 16 and the outwardly extending merchandise supporting section 14.

The base member 13, pursuant to the invention, is a molded plastic part, of a suitable engineering plastic material, such as, for example, that marketed by DuPont under the trademark "Delrin". Other plastic materials may, of course, be utilized, provided they have adequate strength and stability and are available at favorable cost levels.

Figure 5:
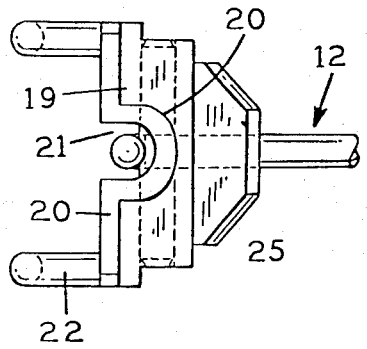
Figure 6:
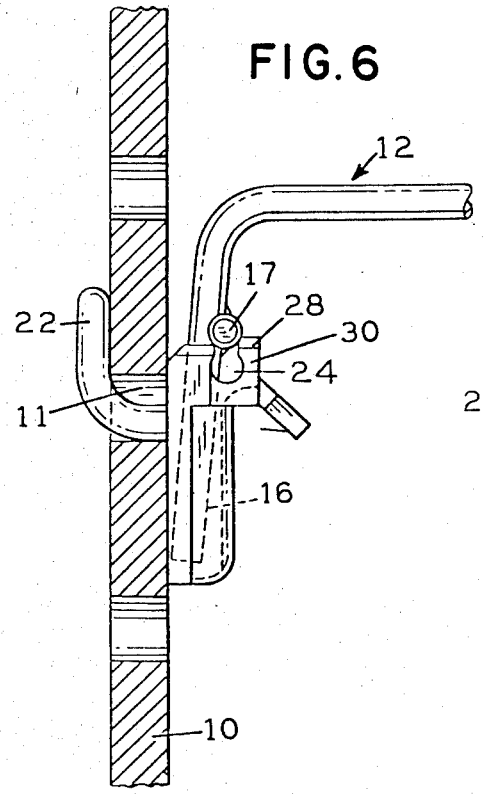
FIGS. 6 and 7 are cross-sectional views, similar to FIGS. 2 and 3, illustrating a simple procedure for effecting initial assembly of the wire merchandise support to the plastic base member.
Figure 7:
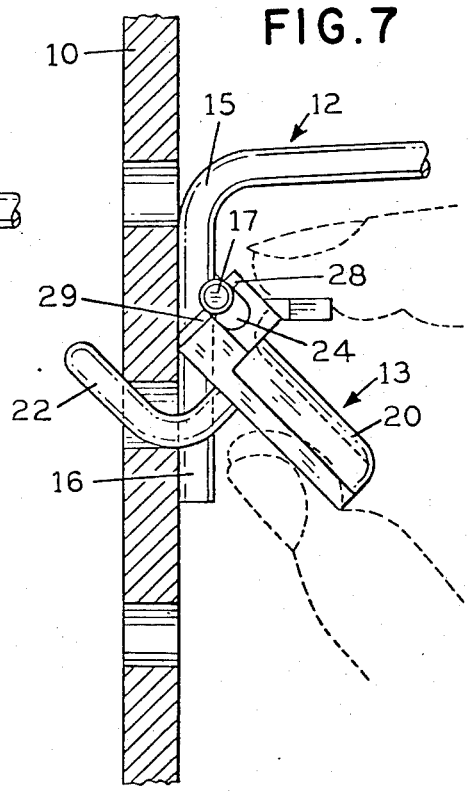

In the illustrated form of the invention, the plastic base member 13 includes a pair of generally flat side panels 19 joined by a vertically extending rib-like central section 20. Each of the side panels mounts a rearwardly extending, L-shaped mounting lug 22, which may be of conventional configuration and dimensions adapted for reception in an adjacent pair of panel board openings 11 in a well-known manner. The rib-like central section 20 is formed with a rearwardly opening, vertically extending recess 21 (see FIGS. 4 and 5) of sufficient depth to fully receive the stabilizing portion 16 of the wire member. Where desired, as in the illustrated device, the recess 21 may be sufficiently large to receive wire members of different sizes.

Extending horizontally across the top of the plastic base member 13 is a forwardly extending top flange 23 provided with a horizontal upwardly opening hinge recess 24 for reception of the hinge bar 17. To particular advantage, the upwardly opening recess 24 has a cross-section configuration which is generally cylindrical in the lower portion, having a width (front to back) dimension of the top which is somewhat smaller than the diameter of the hinge bar 17. Accordingly, insertion of the hinge bar 17 into the recess invovles the application of some pressure to deflect the plastic material on opposite sides of the recess opening in order to accommodate entry of the hinge bar. Once the hinge bar has been fully seated in the recess, it is semi-permanently retained therein, so that the two primary components will remain in an assembled relation unless and until intentionally separated. In practice, this likely will not occur, because of the unique functional aspects of the device.

When the wire and base member 12,13 are assembled by insertion of the hinge bar 17 into the base recess 24, the assembled unit provides the important functional advantages of the Thalenfeld U.S. Pat. No. 3,289,993. That is, for insertion and removal of the hook from the panel board 10, the plastic base member may be pivoted on the hinge bar 17, by lifting the lower portion of the base member outward and upward with respect to the panel board 10. In FIG. 3, the base member 13 is shown in a partially upwardly pivoted position. Upon continuing movement of the base, until the base is generally at right angles to the main panel board 10, the lugs 22 become generally aligned with the panel board apertures 11, allowing the display hook to be either removed or inserted by a generally horizontal movement toward or away from the panel board 10. To facilitate such upward pivoting movement, the plastic base member 13 advantageously is provided with an integral outwardly and downwardly extending finger-engageable flange 25. By merely placing a thumb of finger under the flange 25 and pressing upwardly, the base member 13 is easily pivoted to its install/remove position, as will be appreciated.

As reflected in particularly FIGS. 2 and 3, the upper rearward corner area of the top flange 23 is rounded or beveled, as at 26, to avoid undesirable interference with the front surface of the panel 10 during upward pivoting movement of the base member. Similarly, the outwardly extending flange 23 is provided with an upwardly opening, forwardly extending recess 27, which receives the stabilizing portion 16 of the wire, when the base member is pivoted upwardly.

In one of the more advantageous forms of the invention, substantial self-locking characteristics are incorporated into the hook design, so that it is extremely difficult, if not, impossible, for the hook to become accidentally dislodged from its mounted location. To this end, the hinge recess 24 is so located in the base member 13 as to support the hinge bar 17 at a level such that the axis the hinge bar is above, the top of the panel opening 11 in which the lugs 22 are inserted. In addition to this, the hinge bar 17 is spaced substantially below the portions of the wire hook 12 which contact the front of the panel when the hook is tilted upwardly. This geometric relationship imparts reliable self-locking action to the hook and effectively prevents accidental dislodgement of the hook by reason of upward tilting force applied to the wire section 14. When this occurs, the wire contact the front surface of the panel board 10, in the region of the radius bend 15, which is well above the level of the hinge bar 17. The direction of outward force upon the hinge bar is thus nearly horizontal and, being applied at a level above the upper portion of the panel apertures 11, does not exhibit a tendency to pivot the base element in an upward or release direction, but rather tends to be drawn more tightly closed.

The merchandise hook of the present invention represents a very significant advance in the art, in that it enables all of the functional superiority of the patented Thalenfeld hook to be realized in a device which has the cost advantages of a conventional, but functionally inferior two-part plastic base hook. In other words, both the primary metal hook member and the plastic base member may be manufactured on high speed, mass production equipment at extremely low unit cost, and since assembly of the base member to the wire member is typically to be carried out by the customer, such assembly does not form a component of the manufacturing cost of the device. Because of the unique geometrical arrangement of the hook mounting, locating the axis of the huge bar above the top of the panel apertures in which the book is inserted, upward forces on the book, when resisted by the L-shaped lugs, tend to draw the base member 13 more tightly against the apertured panel 10 with an automatic self-locking action.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a two-part display hook assembly or the like of the type adapted for mounting on a display panel provided with mounting apertures (a) a merchandise support element or the like provided with a generally vertically extending stabilizing portion, (b) said stabilizing portion being disposed, when said assembly is installed on a display panel, in confronting and contacting relation to said panel, (c) horizontal hinge bar means secured to said stabilizing portion between the upper and lower extremities thereof and defining a hinge axis, (d) a base member having rearwardly and upwardly projecting L-shaped mounting lugs for mounting said base member to an apertured display panel and having hinge bar receiving recess means formed therein, (e) said hinge bar means being received in said recess means to provide for pivoting movement of said base member relative to said support element about said hinge axis, (f) said recess means being so located with respect to the bottoms of said mounting lugs as to locate the hinge axis of said hinge bar means at a level above the tops of the panel apertures in which said mounting lugs are received, when said display hook assembly is mounted on an apertured display panel, (g) said stabilizing portion including a portion extending upward above said hinge bar means in close proximity to the front of said panel.

2. A display hook assembly according to claim 1, further characterized by (a) said merchandise support element comprising a wire-like element, (b) said stabilizing element being integral with and forming a downward extension of said wire-like element, (c) said hinge bar means comprising a horizontally disposed wire-like section welded to the front of said stabilizing element at a location spaced below the point at which contact is made between said support element and/or stabilizing element and said display panel when said stabilizing element is tilted upwardly.

3. A display hook assembly according to claim 2, further characterized by (a) said base member having a portion extending downward from said hinge bar means and having a vertically extending rearwardly opening recess for receiving lower portions of said stabilizing element.

4. A display hook assembly according to claim 1, further characterized by (a) said base member being formed of molded plastic and being removably attached to said hinge bar.

* * * * *